US011326739B2

(12) United States Patent
Wei et al.

(10) Patent No.: US 11,326,739 B2
(45) Date of Patent: May 10, 2022

(54) CRYOSTAT

(71) Applicant: Nuctech Company Limited, Beijing (CN)

(72) Inventors: Hongyan Wei, Beijing (CN); Yulan Li, Beijing (CN); Jianping Chang, Beijing (CN); Haijun Yu, Beijing (CN); Xiuxia Li, Beijing (CN); Hong Li, Beijing (CN); Li He, Beijing (CN)

(73) Assignee: NUCTECH COMPANY LIMITED, Beijing (CN)

( * ) Notice: Subject to any disclaimer, the term of this patent is extended or adjusted under 35 U.S.C. 154(b) by 479 days.

(21) Appl. No.: 16/373,770

(22) Filed: Apr. 3, 2019

(65) Prior Publication Data

US 2019/0301677 A1 Oct. 3, 2019

(30) Foreign Application Priority Data

Apr. 3, 2018 (CN) ..... 201810292256.2

(51) Int. Cl.

| | |
|---|---|
| ***F17C 3/08*** | (2006.01) |
| ***F25D 3/10*** | (2006.01) |
| ***F25D 29/00*** | (2006.01) |
| ***F25D 19/00*** | (2006.01) |

(Continued)

(52) U.S. Cl.

CPC ..... *F17C 3/085* (2013.01); *F25B 9/14* (2013.01); *F25D 3/10* (2013.01); *F25D 19/00* (2013.01);

(Continued)

(58) Field of Classification Search

CPC ..... F17C 3/085; F17C 2250/0663; F17C 2250/0417; F17C 2203/0391;

(Continued)

(56) References Cited

U.S. PATENT DOCUMENTS 5,129,232 A * 7/1992 Minas ..... H01F 6/04 62/297

2006/0022779 A1 2/2006 Jiang et al.

(Continued)

FOREIGN PATENT DOCUMENTS

CN 103742783 A 4/2014
CN 105122487 A 12/2015

(Continued)

OTHER PUBLICATIONS

Extended European Search Report dated Aug. 30, 2019 received in European Application No. 19 16 7000.9.

*Primary Examiner* — John F Pettitt, III
(74) *Attorney, Agent, or Firm* — Scully Scott Murphy & Presser

(57) ABSTRACT

A cryostat includes a room temperature vessel, a low temperature vessel, and a refrigeration mechanism. The room temperature vessel includes a room temperature tank, an outer neck tube and a sealing head. The low temperature vessel includes a low temperature tank, an inner neck tube and a liquefaction chamber. The liquefaction chamber corresponds to the first opening and passes through the first opening. The refrigeration mechanism includes a device panel and a refrigeration device. The device panel is disposed on the sealing head. The refrigeration device includes a body and a cold finger. The body is disposed at the device panel. The cold finger is connected with the body and extends into the liquefaction chamber.

12 Claims, 2 Drawing Sheets

(51) Int. Cl.
*F25B 9/14* (2006.01)
*H01F 6/04* (2006.01)

(52) U.S. Cl.
CPC ..... *F25D 29/001* (2013.01); *H01F 6/04* (2013.01); *F17C 2203/0391* (2013.01); *F17C 2250/0417* (2013.01); *F17C 2250/0663* (2013.01); *F17C 2270/0509* (2013.01); *F25D 2201/14* (2013.01)

(58) Field of Classification Search
CPC ..... F17C 2270/0509; F17C 2270/0527; F17C 2270/0536; F25B 9/14; F25B 9/145; F25B 2400/17; F25D 29/001; F25D 3/10; F25D 2201/14
USPC ..... 62/51.1, 6
See application file for complete search history.

(56) References Cited

U.S. PATENT DOCUMENTS

| | | | | |
|---|---|---|---|---|
| 2012/0011859 | A1 | 1/2012 | Black et al. | |
| 2012/0167598 | A1* | 7/2012 | Diederichs ..... | F25D 19/00 62/50.1 |
| 2017/0205124 | A1 | 7/2017 | Staines | |

FOREIGN PATENT DOCUMENTS

| | | | |
|---|---|---|---|
| DE | 40 19 816 | A1 | 1/1991 |
| JP | S61-225556 | A | 10/1986 |
| JP | 2006-200771 | A | 8/2006 |
| JP | 2012-107868 | A | 6/2012 |
| JP | 2017-31986 | A | 2/2017 |

* cited by examiner

CRYOSTAT

CROSS REFERENCE

This application is based upon and claims priority to Chinese Patent Application No. 201810292256.2, filed on Apr. 3, 2018, the entire contents thereof are incorporated herein by reference.

TECHNICAL FIELD

The present disclosure relates to the technical field of cooling, and in particular to a cryostat.

BACKGROUND

The high-purity germanium detector is a new type of semiconductor radiation detector developed in the 1970s. It has the advantages of high resolution, high detection efficiency, stable performance, wide linear range, etc., and has been more and more widely used in many scientific and social fields such as nuclear power, environment, inspection and quarantine, and biomedicine, astrophysics and chemistry, geology, law, archaeology, metallurgy and materials science.

The energy-band gap of the germanium is only 0.665 ev, and the large amount of leakage current caused by molecular thermal motion makes it impossible for any kind of germanium detector to work at room temperature and thus must be placed and work at a certain low temperature environment. At present, most of germanium detectors select a cooling method in which a cold finger is inserted into liquid nitrogen. In order to ensure a long-term stable operation of the detector, it is necessary to periodically inject liquid nitrogen into the detector Dewar, especially in remote mountainous areas, which greatly increases the operation difficulty and the operating cost, increases the risk of the operator handling the low temperature liquid, and at the same time, spilling of the low temperature liquid can easily cause damage to the detector's control and signal transmission circuitry.

In order to reduce the operation difficulty and operating cost of the high-purity germanium detector liquid nitrogen refrigeration system, a method for improving the maintenance-free characteristics of the system includes: liquid nitrogen automatic control perfusion technology and zero evaporation storage technology. The liquid nitrogen automatic perfusion technology is based on the temperature or liquid level of a certain position in the system as a feedback condition, to control a liquid nitrogen filling valve to be switched on or off by circuit. The liquid nitrogen automatic perfusion system has a complicated structure and requires a large-capacity liquid nitrogen storage tank, which leads to an increase in liquid nitrogen consumption, and is not suitable for the case where multiple detectors are placed at different measurement points, especially areas where transportation and production of the liquid nitrogen are difficult. The zero evaporation storage technology reliquefies the evaporated refrigerant using a refrigerator to achieve zero-loss storage of the refrigerant. However, the microphone noise generated by the mechanical vibration of the refrigerator reduces the detector resolution.

Patent application publication CN103742783A relates to a portable liquid nitrogen filling device with automatic stopping function for high-purity germanium detector. It includes a temperature measuring unit, an automatic control unit and a liquid nitrogen filling unit. The temperature measuring unit measures a temperature at the outlet of the Dewar air pipe, and the temperature is used as a feedback condition to control the air compressor and the electromagnetic valve of the liquid nitrogen filling unit to be opened or closed by the automatic control unit, thus achieving the unattended function during the liquid nitrogen filling process. The above structure only solves the problem about the operation difficulty of the liquid nitrogen refrigeration system of the high-purity germanium detector, and does not fundamentally solve the problem about the liquid nitrogen consumption cost and the liquid nitrogen transportation cost. In addition, the above system has a complicated structure, a large floor area, and is unsuitable for small spaces and remote mountain areas.

Patent application publication CN105122487A discloses a cryostat capable of reducing vibration deriving from a refrigerator, in which a buffer tank communicates with at least one party of a liquefaction chamber of a refrigerator and a gas phase space of a refrigerant groove to increase a gas phase volume of the refrigerant tank and the liquefaction chamber, eliminating the acoustic vibration caused by the liquefaction cycle of the refrigerator. The above patents only weaken the vibration caused by the liquefaction cycle of the refrigerator, and do not impair the interference of the mechanical vibration of the refrigerator itself on the instrument. The above method of vibration reduction is suitable for reducing vibration of a large-capacity cryostat, and the vibration caused by the liquefaction cycle of the small-capacity cryostat refrigerator is very small and can be ignored.

Therefore, it is necessary to improve the existing cryostat in order to improve the vibration reduction effect.

SUMMARY

It is a main objective of the present disclosure to overcome at least one of the above-mentioned deficiencies of the prior art and to provide a cryostat having a better vibration reduction effect.

To achieve the above objective, the present disclosure provides a cryostat including a room temperature vessel, a low temperature vessel and a refrigeration mechanism.

The room temperature vessel includes a room temperature tank, an outer neck tube and a sealing head. The outer neck tube communicates with the room temperature tank. A first opening is disposed on the room temperature tank. The sealing head is disposed to cover the room temperature tank. A second opening and a third opening are disposed on the sealing head. The first opening corresponds to the third opening. The outer neck tube corresponds to the second opening and is exposed outside the sealing head through the second opening. An outer circumference of the outer neck tube is in sealingly contact with the second opening of the sealing head.

A low temperature vessel includes a low temperature tank, an inner neck tube and a liquefaction chamber. The inner neck tube is independent of the liquefaction chamber and communicates with the low temperature tank. The low temperature vessel is housed inside the room temperature tank. Part of the inner neck tube is located inside the outer neck tube. A detector is capable of extending into the inner neck tube. Part of the liquefaction chamber is located inside the room temperature tank. The liquefaction chamber corresponds to the first opening and passes through the first opening.

A refrigeration mechanism includes a device panel and a refrigeration device. The device panel is disposed on the sealing head and has through holes respectively corresponding to the second opening and the third opening. The refrigeration device is installed to the device panel. The refrigeration device includes a body and a cold finger. The body is disposed on the device panel, and the cold finger is connected with the body and extends into the liquefaction chamber.

The beneficial effects of the present disclosure over the prior art are:

1. Two independent openings are disposed on the sealing head for the cold finger to be inserted into the outer neck tube and the refrigeration device to ensure that the detector and the refrigeration mechanism do not interfere with each other, and to reduce the interference of the mechanical vibration of the refrigeration mechanism on the detector, thereby forming a set of low vibration zero evaporation cryostat systems with good integration;

2. In one embodiment, the sealing head on the room temperature vessel can be designed as a flat-shaped sealing head to facilitate placement of the refrigerator system and its related devices.

BRIEF DESCRIPTION OF THE DRAWINGS

The various objects, features and advantages of the present disclosure will become more apparent from the following detailed description of preferred embodiments of the present disclosure in combination with the drawings. The drawings are merely illustrative of the present disclosure and are not necessarily to scale. In the drawings, Same reference numbers generally refer to the same or similar components, wherein.

DETAILED DESCRIPTION

Figure 1:
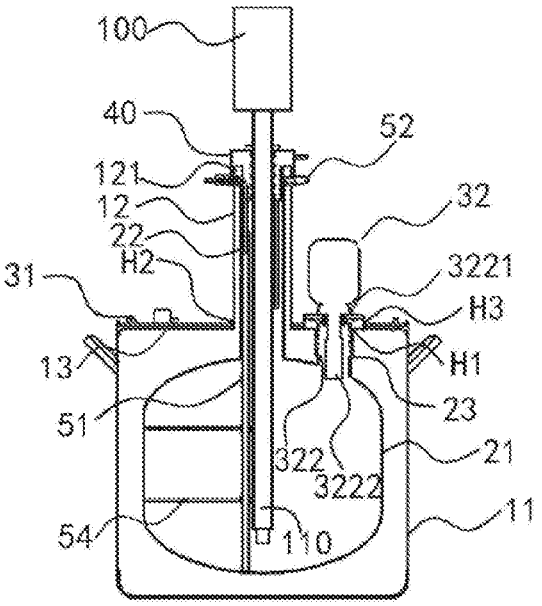
FIG. 1 is a front view of a cryostat of the present disclosure.

Example embodiments will now be described more fully with reference to the accompanying drawings. However, the example embodiments can be embodied in a variety of forms and should not be construed as limitations of the embodiments set forth herein; rather, these embodiments are provided to make the present disclosure more comprehensive and complete, and fully convey the concept of the example embodiments to those skilled in the art. The same reference numbers in the drawings denote the same or similar structures, and thus their detailed description will be omitted.

Relative terms such as "lower" or "bottom" and "higher" or "top" may be used in the embodiments to describe the relative relationship of one component of the icon to another component. It will be appreciated that if the device of the icon is flipped upside down, the component described on the "lower" side will become the component on the "higher" side. In addition, when a layer is "on" another layer or substrate, it may mean that a layer is "directly" on another layer or substrate, or a layer is above another layer or substrate, or there are layers between other layers or substrates.

The present disclosure provides a cryostat, which includes a room temperature vessel, a low temperature vessel and a refrigeration mechanism.

The room temperature vessel includes a room temperature tank 11, an outer neck tube 12 and a sealing head 13. The outer neck tube 12 communicates with the room temperature tank 11. A first opening H1 is disposed at the room temperature tank 11. The sealing head 13 is disposed to cover the room temperature tank 11. A second opening H2 and a third opening H3 are disposed at the sealing head 13. The first opening H1 corresponds to the third opening H3, and the outer neck tube 12 corresponds to the second opening H2 and is exposed outside the sealing head 13 through the second opening. An outer circumference of the outer neck tube 12 is in sealingly contact with the second opening of the sealing head 13.

The low temperature vessel includes a low temperature tank 21, an inner neck tube 22 and a liquefaction chamber 23. The inner neck tube 22 is independent of the liquefaction chamber 23, and both are in communication with the low temperature tank 21. The low temperature vessel is housed inside the room temperature tank 11, part of the inner neck tube 22 is located inside the outer neck tube 12, and the detector 100 is capable of extending into the inner neck tube 22. Part of the liquefaction chamber 23 is located inside the room temperature tank 11. The liquefaction chamber 23 corresponds to the first opening H1 and passes through the first opening H1.

The refrigeration mechanism includes a device panel 31 and a refrigeration device 32. The device panel 31 is disposed at the sealing head 13 and has through holes corresponding to the second opening H2 and the third opening H3, respectively. The refrigeration device 32 is installed to the device panel 31. The refrigeration device 32 includes a body 321 and a cold finger 322. The body 321 is disposed at the device panel 31, and the cold finger 322 is connected with the body 321 and extends into the liquefaction chamber 23.

Figure 2:
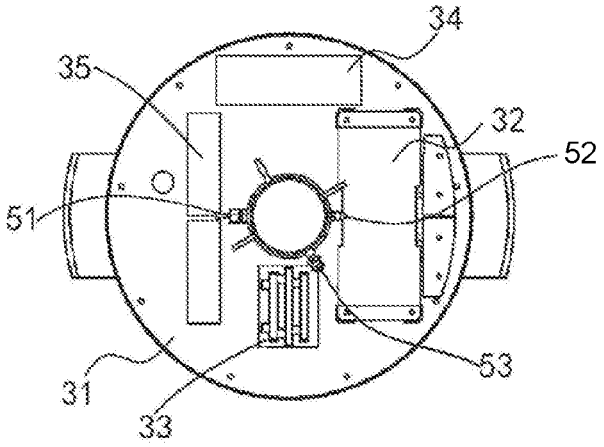
FIG. 2 is a top view of the cryostat of the present disclosure.

In this embodiment, as shown in FIG. 1 and FIG. 2, the sealing head 13 is a flat plate and is fixedly connected with the room temperature tank 11 on which a stud can be welded to fix the device panel 31. The flat sealing head 13 may enable the installation of the refrigerator system and its related devices more stable.

The detector 100 may be a high-purity germanium detector, which is assembled with the cryostat of the present disclosure to form a cryostat system. It has the following effective effects:

1. Two independent openings are disposed at the sealing head for the cold finger to be inserted into the outer neck tube and the refrigeration device to ensure that the detector and the refrigeration mechanism do not interfere with each other, and to reduce the interference of the mechanical vibration of the refrigeration mechanism on the detector, thereby forming a set of low vibration zero evaporation cryostat systems with good integration;

2. The sealing head at the room temperature vessel can be designed as a flat-shaped sealing head to facilitate placement of the refrigerator system and its related devices.

The specific structure of the cryostat is described in detail below. In this embodiment, the cryostat cooperates with the high purity germanium detector. It should be understood that the type of the detector 100 is not limited thereto, and may be any other detector 100 system that has a independent vacuum and cold conduction structure.

In this embodiment, the refrigeration device 32 may be a pulse tube refrigerator or a Stirling refrigerator, preferably a low vibration and long-life pulse tube refrigerator. Moreover, the embodiment adopts the integral pulse tube refrigerator, which may be compact in structure and save installation space.

In this embodiment, the refrigeration mechanism may further include a control system 33, a DC power source 34, and a heat dissipation fan 35, all of which are installed on the device panel 31, so that it has good integration and small floor area. The DC power source 34 supplies power to power devices such as the refrigeration device 32 and the heat dissipation fan 35. The heat dissipation fan 35 is used for heat dissipation of the refrigerator and the DC power source 34.

In order to improve the maintenance-free characteristics of the system, the system carries out the pressure feedback adjustment, i.e., the control system 33 performs PID calculation according to the error of the pressure inside the low temperature vessel with respect to the target pressure, controls the output of the refrigerator, and performs closed-loop control on the internal pressure of the thermostat to keep a micro-positive pressure inside the low temperature vessel. The refrigerant in the thermostat is sealingly stored. If the liquid state is volatilized into a gaseous state, the pressure of the system will rise, and if the pressure of the system is constant, the refrigerant inside the system will not be volatilized. Also, it may respond to the change in the ambient temperature of the system, the change in the temperature at the hot-end of the refrigerator, and fluctuations of the performance of the refrigerator, so as to automatically achieve long-term non-destructive storage of the refrigerant. When operation of the refrigeration mechanism stops after outage, the remaining liquid nitrogen in the low temperature vessel can maintain the detector 100 to be in the working temperature, and the detector 100 can continue to work.

Therefore, compared with the liquid nitrogen stored in the ordinary Dewar, the liquid nitrogen in the cryostat of the present embodiment can be maintained for a long time, for example, as long as about 2 years.

In this embodiment, the device panel 31 is detachably connected with the sealing head 13, and the movable device panel 31 facilitates the arrangement of the refrigeration device 32 and the control unit.

The working pressure of the low temperature vessel is about 2.0 bar, and the material of the low temperature vessel may be stainless steel or high-strength aluminum. The low temperature tank 21 may accommodate liquid refrigerant therein, and the outer wall thereof is coated with a layer of heat insulating material with a certain thickness. The refrigerant includes, but is not limited to, liquid nitrogen, such as liquid oxygen, liquid argon.

The material of the room temperature tank 11 may be selected from stainless steel or high-strength aluminum. A fourth opening (not shown) is further disposed on the room temperature tank 11, and a fifth opening (not shown) corresponding to the fourth opening is disposed on the sealing head 13. The fourth opening and the fifth opening act as vacuum extract openings of the Dewar for vacuuming between the room temperature vessel and the low temperature vessel therethrough. The vacuum multilayer insulation technology may be used between the inner neck tube 22 and the outer neck tube 12, and the inner neck tube 22 and the outer neck tube 12 (i.e., the insertion port of the detector 100) is made of a stainless steel thin-walled tube, reducing the convective heat leakage and heat conduction loss at the neck tube.

The low temperature tank 21 and the room temperature tank 11 are respectively connected to both ends of the liquefaction chamber 23, and then the refrigerant volatilized in the low temperature tank 21 is liquefied to ensure zero loss of the refrigerant in the low temperature tank. The liquefaction chamber 23 may select a stainless steel thin-walled bellows, and the outer wall of the stainless steel thin-walled bellows may utilize the high-vacuum multilayer insulation technology to reduce the heat conduction loss of the liquefaction chamber 23.

Figure 3:
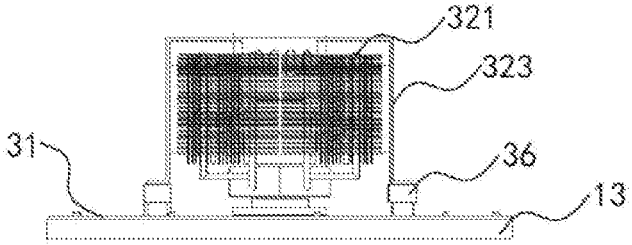
FIG. 3 is a schematic view of the vibration isolation design of the refrigeration mechanism of the cryostat of the present disclosure.

As shown in FIG. 3, the refrigeration mechanism further includes a first vibration isolator 36 disposed at the device panel 31, and the first vibration isolator 36 is used to install the refrigeration device 32. The refrigeration device 32 further includes a body support frame 323 for carrying the body 321 (compressor), and four corners of the body support frame 323 are fixed on the first vibration isolator 36.

Figure 4:
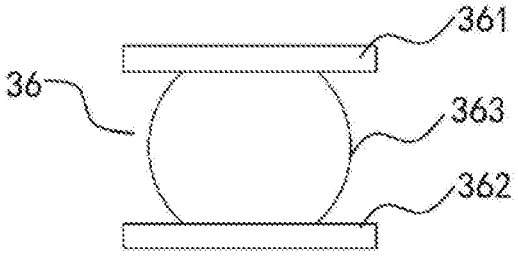
FIG. 4 is a schematic view of a first vibration isolator of the refrigeration mechanism of the present disclosure.

As shown in FIG. 4, the first vibration isolator 36 includes an upper isolating plate 361, a lower isolating plate 362, and a vibration isolation portion 363 interposed between the upper isolating plate 361 and the lower isolating plate 362. The lower isolating plate 362 is fixed at the device panel 31, and four corners of the body support frame 323 are fixed at the upper isolating plate 361. The upper isolating plate 361 and the lower isolating plate 362 may be metal plates such as plates that is made of stainless steel or aluminum alloy. The vibration isolation portion 363 may be a spherical rubber with small rigidity. The rubber ball may be selected to simultaneously reduce the vibration in three directions (x, y, z), and the vibration isolator may be machined by opening mould.

Figure 6:
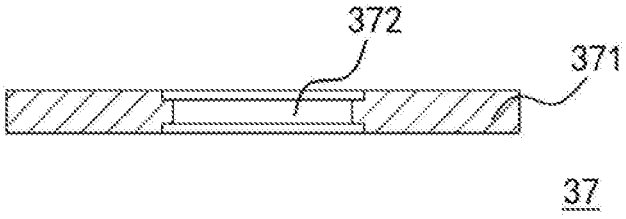
FIG. 6 is a schematic view of a third vibration isolator of the present disclosure.

In this embodiment, as shown in FIG. 1 and FIG. 6, the refrigeration mechanism may further include a second vibration isolator 37 disposed between the cold finger 322 and the room temperature tank 11. The second vibration isolator 37 may be a structural member formed of any organic material with less rigidity, such as rubber.

The cold finger 322 includes a hot-end flange 3221 and a finger body 3222, and the hot-end flange 3221 protrudes and is connected to one end of the finger body 3222. The second vibration isolator 37 includes a second connecting portion 371 and a second perforation 372 penetrating through upper and lower surfaces of the second connecting portion 371. The second connecting portion 371 is connected between the hot-end flange 3221 and the upper surface of the room temperature tank 11. The second connecting portion 371 may be screwed to the upper surface of the room temperature tank 11. The hot-end flange 3221 is placed above the second connecting portion 371, and a side wall of the hot-end flange 3221 is sealingly contact with a convex portion of the second connecting portion 371. The finger body 3222 is inserted into the liquefaction chamber 23 through the second preforation 372. The inner wall of the second through hole 372 may have a convex portion, and the upper end (ie, the room temperature end) of the finger body 3222 may be in sealingly contact with the convex portion, thereby achieving vibration reduction and sealing functions.

In the sealed low temperature vessel, the volatilized nitrogen gas is liquefied by the cold finger 322 and then returned to the low temperature tank 21. Since the cryostat is well sealed and thus the refrigerant is zero-loss, it is not necessary to add liquid nitrogen for a long time, which greatly saves manpower and material resources.

Therefore, vibration isolation between the device panel 31 and the body 321 of the refrigeration mechanism is achieved by the first vibration isolator 36, and vibration isolation between the refrigeration mechanism and the room temperature tank 11 is achieved by the second vibration isolator 37. Under the premise of ensuring the sealing, the direct contact between metal parts in the cryostat is avoided to effectively avoid the main vibration source of the cryostat (vibration generated during the operation of the refrigeration mechanism), so that the embodiment has functions of vibration reduction and sealing.

Figure 5:
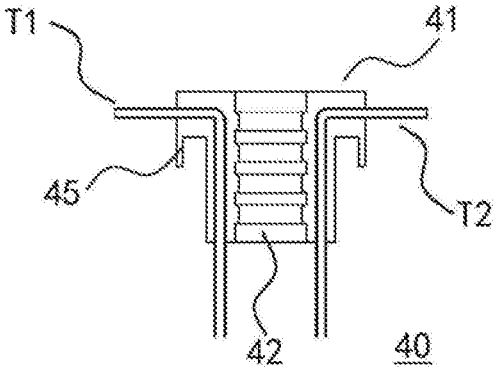
FIG. 5 is a schematic view of a second vibration isolator of the present disclosure.

In this embodiment, as shown in FIGS. 1 and 5, the cryostat may further include a third vibration isolator 40 disposed between the cold finger 322 and the outer neck tube 12 of the detector 100.

The third vibration isolator 40 may include a third connecting portion 41 and a third perforation 42 penetrating through upper and lower surfaces of the third connecting portion 41. The end of the outer neck tube 12 is provided with a nozzle flange 121, and the end of the inner neck tube 22 is connected to the nozzle flange 121. The lower surface of the third connecting portion 41 is sealingly connected with the nozzle flange 121. The detector 100 includes a detecting cold finger 110 that is inserted through the third perforation 42 into the inner neck tube 22 and into the refrigerant, and the detecting cold finger 110 is in sealingly contact with the third perforation 42.

A hole wall of the third perforation 42 has a concave-convex structure, and a convex portion of the concave-convex structure grips the side wall of the detecting cold finger 110. The detector 100 may further include a snap ring disposed to an outer circumference of the upper portion of the detecting cold finger 110, and fixed to the upper surface of the third connecting portion 41.

A first tube hole 43 and a second tube hole 44 are disposed on the outer circumference of the third connecting portion 41 for respectively perforating through a liquid filling tube T1 and an air outlet tube T2. One end of each of the liquid filling tube T1 and the air outlet tube T2 is located outside the third connecting portion 41, and the other end of each of the liquid filling tube T1 and the air outlet tube T2 extends into the inner neck tube 22. An outer circumference of the third connecting portion 41 is provided with a flange 45 which includes a horizontal sealing surface and a vertical sealing surface, such that the flange 45 sealingly covers the nozzle flange 121.

Therefore, by providing the third vibration isolator 40 between the detector 100 and the outer neck tube 12, the mechanical vibration at the detector 100 is extremely small, and has substantially no influence on the resolution of the detector 100, thereby ensuring the detection accuracy of the detector 100. In addition, an effective seal between the detector 100 and the inner neck tube 22 or the outer neck tube 12 can be achieved.

As shown in FIG. 1, the cryostat may further include a liquid level measuring mechanism including a liquid level sensor 51, a display, a data line and the like, and the liquid level sensor 51 extends into the low temperature tank 21. Three threaded holes are disposed to the side wall of the nozzle flange 121 for respectively arranging the liquid level sensor 51, the pressure sensor 52 and the safety valve 53. In this embodiment, the electrode lead-out piece of the liquid level sensor 51 is exposed to the nozzle flange 121 via one of threaded holes, and is in sealingly contact with threaded holes.

The liquid level sensor 51 may be a capacitive liquid level sensor, and its stricture design is convenient for maintenance and replacement. Compared with the temperature type liquid level sensor, its liquid level measurement is more accurate; the low temperature tank 21 has a positioning beam 54 therein for supporting and limiting the liquid level sensor 51. In this embodiment, there are two positioning beams 54, which limits the capacitance portion of the sensor from left and right. The electrode in the liquid level sensor 51 is led out from the side wall of the nozzle flange 121 through the electrode lead-out piece and the sealing member, and then connected to the system control circuit. The liquid level sensor 51 utilizes a post-assembly type, which facilitates replacement and maintenance of the liquid level sensor 51. The liquid level display may display nearby and remotely and has a function of liquid level low threshold alarm to monitor the liquid level or the content percentage of liquid nitrogen in real time, and inform the user to inject liquid nitrogen in advance by means of alarm.

Therefore, the present embodiment combines the active refrigeration of the low-vibration long-life mechanical refrigerator with the passive thermal insulation of the high-vacuum multilayer thermal insulation Dewar to realize zero-evaporation storage of refrigerant in the low temperature Dewar, maintain the constant temperature and constant pressure of the low temperature Dewar and provide a stable and low temperature environment for the detector. The low vibration pulse tube refrigerator and the reasonable vibration isolation design realize the purpose that the mechanical vibration has no influence on the resolution of the detector. The zero evaporation cryostat has small vibration, good integration, low operation difficulty and high maintenance-free.

In summary, compared with the prior art, the present disclosure moves the accelerator in a pulling manner, greatly reducing the operation difficulty and improving the maintenance and debugging efficiency of the high-power accelerator. Moreover, by utilizing the pull-type carrying device of the present disclosure, debugging or maintenance can be implemented inside the accelerator cabin structure, so that it is not necessary to reserve a space volume outside the accelerator cabin, thereby improving the utilization of the internal space of the cabin and avoiding the waste of the outer space of the cabin.

While the present disclosure has been described with reference to the exemplary embodiments, it should be understood that the used terms are illustrative and exemplary, but not limitative. As the present disclosure may be embodied in a variety of forms without departing from the spirit or scope of the present disclosure, it should be understood that the present disclosure is not limited to the details in the foregoing, and should be broadly interpreted within the spirit and scope defined by the appended claims. Therefore, all changes and variations that come within the scope of the claims and their equivalents are intended to be covered by the appended claims.

What is claimed is:

1. A cryostat comprising:

a room temperature vessel comprising a room temperature tank, an outer neck tube and a sealing head, the outer neck tube communicating with the room temperature tank, a first opening being disposed at the room temperature tank, the sealing head being disposed to cover the room temperature tank, a second opening and a third opening being disposed at the sealing head, the first opening being in communication with the third opening, the outer neck tube passing through the second opening to be exposed outside the sealing head, and an outer circumference of the outer neck tube being in sealingly contact with the second opening of the sealing head;

a low temperature vessel comprising a low temperature tank, an inner neck tube and a liquefaction chamber, the inner neck tube being independent of the liquefaction chamber and communicating with the low temperature tank, the low temperature vessel being housed inside the room temperature tank, part of the inner neck tube being located inside the outer neck tube, the liquefaction chamber being partially located inside the room temperature tank, and part of the liquefaction chamber passing through the first opening; and a refrigeration mechanism comprising a device panel and a refrigeration device, the device panel being disposed at the sealing head and having through holes respectively in communication with the second opening and the third opening, the refrigeration device being installed to the device panel, the refrigeration device comprising a body and a cold finger, the body being disposed at the device panel, and the cold finger being connected with the body and extending into the liquefaction chamber.

2. The cryostat according to claim 1, wherein the sealing head is a flat plate that is fixedly connected with the room temperature tank.

3. The cryostat according to claim 1, wherein the device panel is detachably connected with the sealing head.

4. The cryostat according to claim 2, wherein an outer wall of the low temperature tank is coated with a layer of thermal insulating material.

5. The cryostat according to claim 2, wherein the refrigeration mechanism further comprises a first vibration isolator disposed at the device panel, the first vibration isolator being used to install the refrigeration device.

6. The cryostat according to claim 5, wherein the refrigeration device further comprises a body support frame for carrying the body, and four corners of the body support frame are fixed at the first vibration isolator.

7. The cryostat according to claim 6, wherein the first vibration isolator comprises an upper isolating plate, a lower isolating plate, and a vibration isolation portion interposed between the upper isolating plate and the lower isolating plate, the lower isolating plate is fixed at the device panel, and the four corners of the body support frame are fixed at the upper isolating plate.

8. The cryostat according to claim 7, wherein the upper isolating plate and the lower isolating plate are metal plates, and the vibration isolation portion is a spherical rubber.

9. The cryostat according to claim 2, wherein the refrigeration mechanism further comprises a second vibration isolator disposed between the cold finger and the room temperature tank.

10. The cryostat according to claim 2, further comprising a third vibration isolator, wherein the third vibration isolator comprises a third connecting portion and a third perforation perforating through upper and lower surfaces of the third connecting portion; wherein an end of the outer neck tube is provided with a nozzle flange, which is in sealingly contact with the lower surface of the third connecting portion; and further comprising a detector comprising a detecting cold finger which is inserted into the inner neck tube through the third perforation and is in sealingly contact with the third perforation.

11. The cryostat according to claim 2, wherein a wall portion of the liquefaction chamber is a stainless steel bellows, and an outer surface of the wall portion of the liquefaction chamber is covered with a layer of thermal insulating material.

12. The cryostat according to claim 10, wherein the cryostat further comprises a liquid level measuring mechanism comprising a liquid level sensor extending into the low temperature tank.

* * * * *